US005544807A

United States Patent [19]

Kreider

[11] Patent Number: 5,544,807

[45] Date of Patent: Aug. 13, 1996

[54] MAILER ASSEMBLY

[75] Inventor: Russell L. Kreider, Boothwyn, Pa.

[73] Assignee: International Business Systems, Incorporated, King of Prussia, Pa.

[21] Appl. No.: 384,518

[22] Filed: Feb. 6, 1995

[51] Int. Cl.[6] ..... B65D 27/06

[52] U.S. Cl. ..... 229/305; 229/69; 462/4

[58] Field of Search ..... 229/69, 305; 462/4, 462/3, 2; 383/37

[56] References Cited

U.S. PATENT DOCUMENTS

| | | | |
|---|---|---|---|
| 2,143,622 | 1/1939 | Fulk . | |
| 2,246,234 | 6/1941 | Antrim . | |
| 2,546,698 | 3/1951 | Nicolle | 383/37 |
| 2,907,585 | 10/1959 | Sornberger et al. . | |
| 3,104,799 | 9/1963 | Steidinger . | |
| 3,160,424 | 12/1964 | Eichorn et al. | 462/4 |
| 3,304,103 | 2/1967 | Bensler, Sr. et al. . | |
| 3,806,165 | 4/1974 | Skees . | |
| 3,941,308 | 3/1976 | DiGirolomo et al. . | |
| 3,967,776 | 7/1976 | Getsch et al. . | |
| 4,010,889 | 3/1977 | Allen et al. . | |
| 4,095,695 | 6/1978 | Steidinger . | |
| 4,108,352 | 8/1978 | Peschke . | |
| 4,157,759 | 6/1979 | Dicker . | |
| 4,277,016 | 7/1981 | Wakeman et al. . | |
| 4,346,916 | 8/1982 | Shelton . | |
| 4,361,269 | 11/1982 | Neubauer . | |
| 4,384,670 | 5/1983 | Dicker | 229/305 X |
| 4,492,334 | 1/1985 | Dicker . | |
| 4,705,298 | 11/1987 | VanMalderghem . | |
| 4,844,329 | 7/1989 | Dicker . | |
| 5,038,999 | 8/1991 | Dicker . | |
| 5,052,977 | 10/1991 | Irvine . | |
| 5,172,855 | 12/1992 | Coffey | 229/305 |

FOREIGN PATENT DOCUMENTS

| | | | |
|---|---|---|---|
| 790434 | 7/1968 | Canada . | |
| 0055509 | 7/1982 | European Pat. Off. . | |
| 845994 | 9/1939 | France | 462/4 |

*Primary Examiner*—Jes F. Pascua

*Attorney, Agent, or Firm*—Wood, Herron & Evans, P.L.L.

[57] ABSTRACT

A continuous business forms assembly comprises a plurality of interconnected units stackable into an array, with each unit including a first ply and a second ply. The first ply of one of the units is connected to the first ply of an adjacent unit with a series of transversely spaced ties. The second ply of the one unit is connected to the second ply of the adjacent unit with a series of transversely spaced ties which are transversely offset with respect to the first ply ties. When the business forms assembly is folded at the interconnection of the adjacent units, the first and second plies combine to form only a single ply thickness which is required to be folded.

1 Claim, 3 Drawing Sheets

MAILER ASSEMBLY

FIELD OF THE INVENTION

This invention relates generally to continuous business forms assemblies, and more particularly to continuous mailer assemblies.

BACKGROUND OF THE INVENTION

Continuous mailer assemblies are utilized by businesses for billing and payment collection purposes. A typical continuous mailer assembly may include a plurality of plies, with each ply of the plurality forming a different part of the mailer. For example, one such mailer is known as a two-way insert plysaver mailer. Such a mailer includes five plies through its thickness, with the plies being adhesively or otherwise secured one to another. The top or first ply is known as the fly sheet, the second ply is the face sheet of an outgoing envelope, the third ply is an insert, the fourth ply is the face sheet of a return envelope, and the fifth ply is the back of both the outgoing and return envelopes. The mailer includes pin feed holes in the lateral margins of the mailer for feeding a continuous series of interconnected mailers into a computer driven printer. After being printed, the fly sheet is retained by the business, and the mailer comprised of the second through the fifth plies is mailed to the customer. Upon receipt, the second ply, which is the face sheet of the outgoing envelope, is removed to reveal the insert. The insert is detached from the balance of the mailer, the customer retains a portion of the insert, and the remainder of the insert, known as a remittance stub, is placed between the fourth and fifth plies of the mailer along with payment. The fourth and fifth plies are then sealed to define a secure return envelope, which is then mailed by the customer back to the business.

As mentioned above, these continuous mailer assemblies are printed on computer driven printers. A continuous mailer assembly comprises a plurality of interconnected mailer units, each of which may include the various plies discussed above; alternatively, other types of mailers may be employed. The continuous mailer assembly is typically stacked into an array for feeding into the printer. The interconnected mailer units are folded in zig-zag fashion to form the array. The folded mailer units thus unfold to feed into the printer and then are refolded to form an array after being printed.

A problem associated with such continuous mailer assemblies is that of "tenting" which describes the appearance of the continuous mailer assembly upon unfolding the interconnected mailer units from the stacked array. The continuous mailer assembly resembles a tent, with the apex of the tent being formed at each fold line. Tenting causes the continuous mailer assembly to jam in the printer, which of course is tedious and time consuming to remedy. The problem of tenting is created at least in part by the bulk of the plies at the fold line which are required to be folded.

One solution to the problem of tenting is disclosed in Peschke, U.S. Pat. No. 4,108,352. Peschke discloses completely severing the intermediate plies of a multi-ply, continuous business forms assembly at each cross line of weakening which is folded in order to improve foldability and to alleviate tenting. The intermediate plies may also include transversely aligned notches.

Other solutions are disclosed in Dicker, U.S. Pat. No. 4,492,334; U.S. Pat. No. 4,844,329 and U.S. Pat. No. 5,038,999. Dicker '334 discloses a mailer assembly in which one ply is completely severed from an adjacent ply. Dicker '329 discloses a mailer assembly wherein adjacent plies are connected only by perforated tear strips at the margins. Dicker '999 discloses a mailer assembly including front and back plies wherein one ply has die cut apertures extending a short distance inwardly from the left and right margins, and the other ply has a long die cut aperture extending between the short apertures so that each mailer is connected to an adjacent mailer by the equivalent of only one ply in order to alleviate tenting.

Prior attempts at eliminating tenting in a continuous mailer assembly have either not met with complete success or have been costly to implement. Specifically, completely severing adjacent plies one from another or only connecting adjacent plies with minimal structure at the margins allows the plies to become unstable as the plies are collated atop one another to form the continuous mailer assembly resulting in manufacturing difficulties which require expensive machinery to alleviate.

It is therefore an object of the present invention to provide a mailer assembly which lies flat after being unfolded from an array which is folded in zig-zag fashion and which does not exhibit tenting and which is economical to manufacture and which, in doing so, does not sacrifice the connection of adjacent plies across their widths.

SUMMARY OF THE INVENTION

The present invention attains the stated objectives by providing a continuous business forms assembly comprising a plurality of interconnected units stackable into an array, with each unit including a first ply and a second ply. The first ply of one of the units is connected to the first ply of an adjacent unit with a series of transversely spaced ties. The second ply of the one unit is connected to the second ply of the adjacent unit with a series of transversely spaced ties which are transversely offset with respect to the first ply ties. When the business forms assembly is folded at the interconnection of the adjacent units, the first and second plies combine to form only a single ply thickness which is required to be folded.

A series of transversely spaced slots are provided in the first and second plies of the adjacent units and are separated by the ties. The ties are partially cut transversely. The business forms assembly thus is foldable in zig-zag fashion to form the array, and the interconnection of the adjacent units facilitates folding and unfolding of the interconnected units without tenting.

In a preferred form of the present invention, a continuous mailer assembly comprises a plurality of interconnected units stackable into an array. Each unit includes a front ply, a back ply secured to the front ply to define an envelope and an insert between the front and back plies. The front ply of one of the units is connected to the front ply of an adjacent unit with a series of transversely spaced ties. The back ply of the one unit is connected to the back ply of the adjacent unit with a series of transversely spaced ties which are offset with respect to the first play ties.

In another preferred form, the continuous mailer assembly comprises a plurality of interconnected units, with each unit including a first fly sheet ply, a second outgoing envelope face ply, a third insert ply, a fourth return envelope face ply and a fifth outgoing and return envelope back ply. The second and fifth plies cooperate to define an outgoing envelope, while the fourth and fifth plies cooperate to define the final return envelope. The third ply is disposed between the second and fourth plies. The second and fourth plies of the units are connected to second and fourth respective plies of adjacent units with the aforementioned transversely spaced and offset ties.

A major advantage of the present invention is that a continuous business forms assembly and in particular a continuous mailer assembly is provided which has improved flexibility and less bulk at the fold lines for reducing tenting and for providing smoother printer feeding, yet not at the expense of the interconnection of adjacent plies.

These and other objects and advantages of the present invention will become more readily apparent during the following detailed description taken in conjunction with the drawings herein, in which:

DETAILED DESCRIPTION OF THE INVENTION

Figure 1:
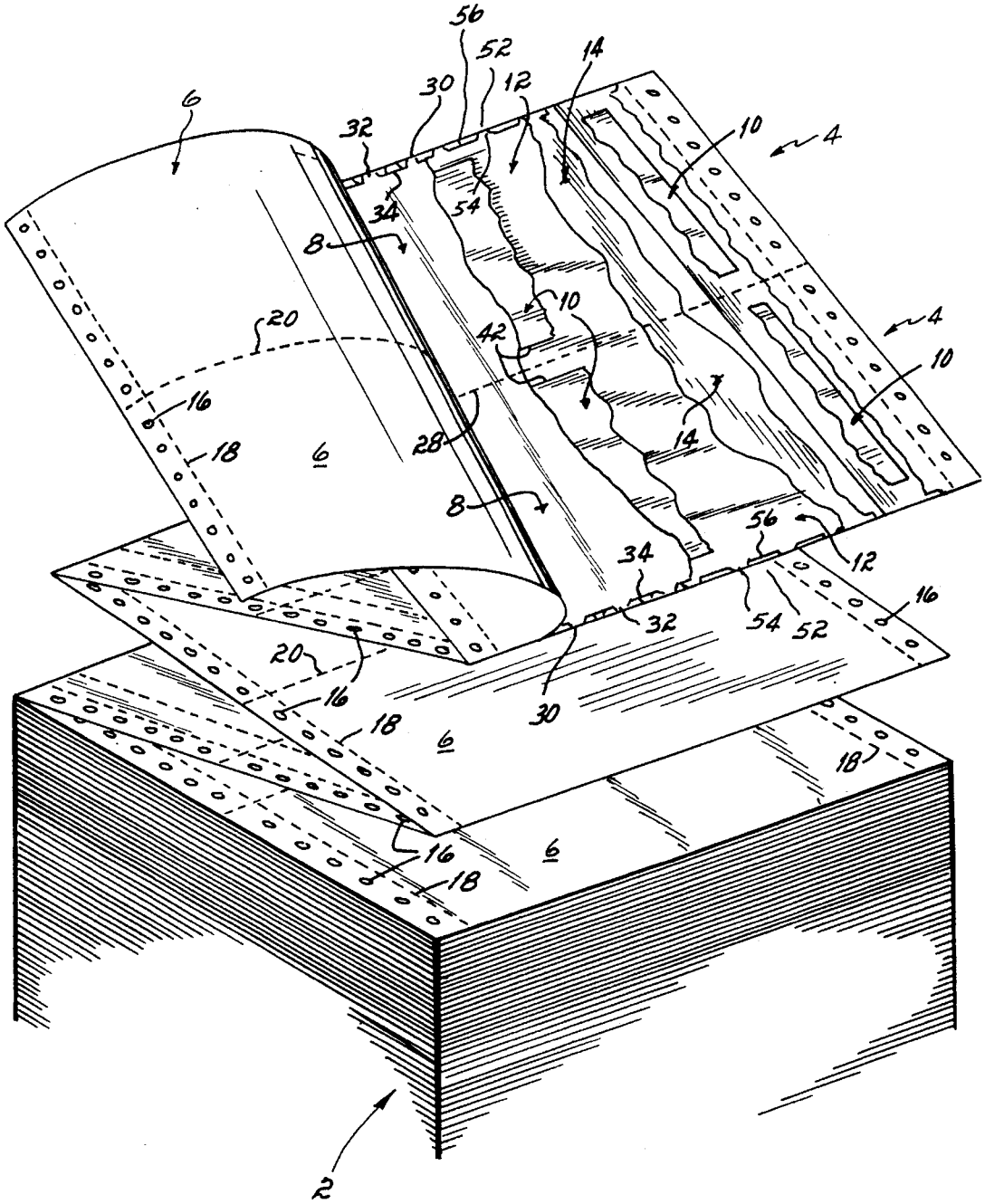
FIG. 1 is a perspective view of an array of a continuous mailer assembly incorporating the principles of the present invention.
Figure 2:
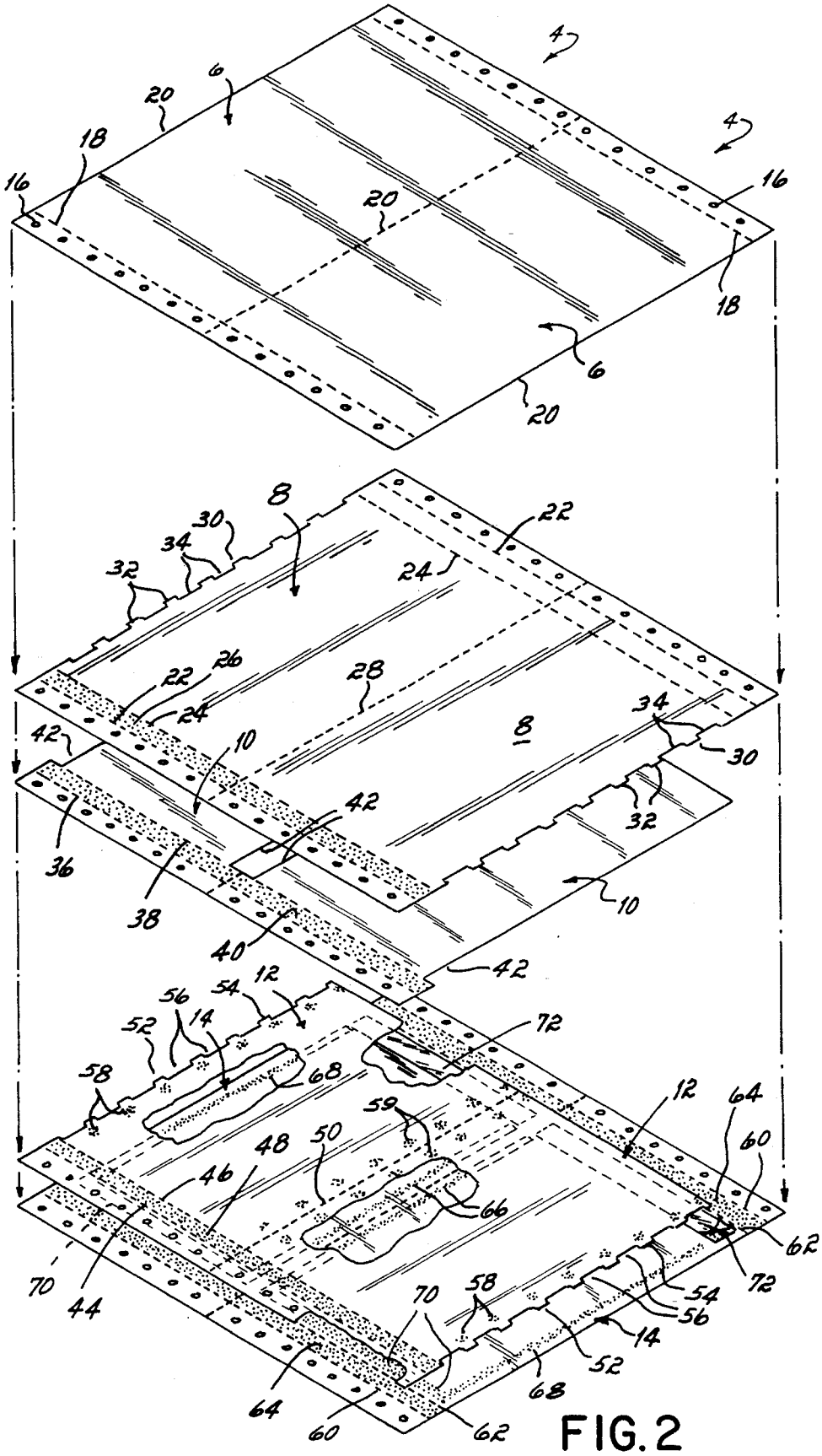
FIG. 2 is an exploded perspective view of two interconnected mailer units from the array of FIG. 1.

Referring first to FIG. 1, there is illustrated a continuous business forms assembly 2 according to the principles of the present invention. More particularly, the continuous business forms assembly 2 takes the form of a continuous mailer assembly comprising a plurality of interconnected mailer units 4. Each unit 4 includes a first ply 6 known as a fly sheet, a second ply 8 which is the face of an outgoing envelope, a third ply 10 which is an insert, a fourth ply 12 which is the face of a return envelope, and a fifth ply 14 which is the back of both the outgoing and return envelopes.

Plies 6, 8 and 14 include pin feed holes 16 in both left and right margins; plies 10 and 12 includes pin feed holes 16 in only the left margin. Pin feed holes 16 are for feeding the assembly 2 through a printer.

Fly sheet ply 6 includes longitudinally oriented lines of perforations 18 laterally inboard of the pin feed holes 16. Fly sheet ply 6 also includes transversely oriented lines of perforations 20 at the top and bottom of each mailer unit 4.

Outgoing envelope face ply 8 includes two longitudinally oriented lines of perforations 22 and 24 laterally inboard of the pin feed holes 16. A glue line 26 is located between the lines of perforations 22 and 24 on the left side of the outgoing envelope face ply 8 for securing the ply 8 to the ply 6. A transversely oriented line of perforations 28 is located on outgoing envelope face ply 8 intermediate fold edges 30. Fold edges 30 of ply 8 include a series of transversely spaced ties 32 and a series of transversely spaced slots 34 which are separated by the ties 32 and which will be described in more detail below.

Insert ply 10 includes a pair of lines of perforations 36 and 38 laterally inboard of the pin feed holes 16 on the left side of the ply 10. A glue line 40 is positioned between the lines of perforations 36 and 38 and is for securing ply 10 to ply 8. The overall height of each insert ply 10 is approximately 3/4 inch shorter than the overall height of the mailer unit 4 thus resulting in relieved areas 42 at the top and bottom of insert ply 10 such that no portion of the insert 10 is folded when the continuous mailer assembly 2 is folded as shown in FIG. 1. Return envelope face ply 12 includes a pair of longitudinally oriented lines of perforations 44 and 46 laterally inboard of the pin feed holes 16 in the left side of the ply 12. A glue line 48 is located between the lines of perforations 44 and 46 and is for securing the ply 12 to the ply 10. A transversely oriented perforations line 50 is positioned intermediate fold edges 52. Each fold edge 52 includes a series of transversely spaced ties 54 and a series of transversely spaced slots 56 which are separated by the ties 54 and which will be described in more detail below. Glue dots 58 are applied to the ply 12 and are positioned transversely in alligning correspondence with the ties 54 and longitudinally inboard of the fold edges 52. Similar glue dots 59 are positioned longitudinally inboard of perforations line 50. Glue dots 58, 59 serve to secure plies 12 to plies 8.

Outgoing and return envelope back ply 14 includes a pair of longitudinally oriented lines of perforation 60 and 62 positioned transversely inboard of the pin feed holes 16 in each margin edge. A glue line 64 is positioned between each of the pairs of lines of perforation 60 and 62 and is for securing ply 14 to ply 12 (on the left side) and to ply 8 (on the right side). In addition, transversely oriented glue lines 66 and 68, and a longitudinally oriented glue line 70, secure ply 14 to ply 12. On the right side of ply 14 inboard of perforation line 62 there is a strip of remoist glue 72 which, when folded over the right hand edge of ply 12, seals the pocket of the return envelope.

Figure 3:
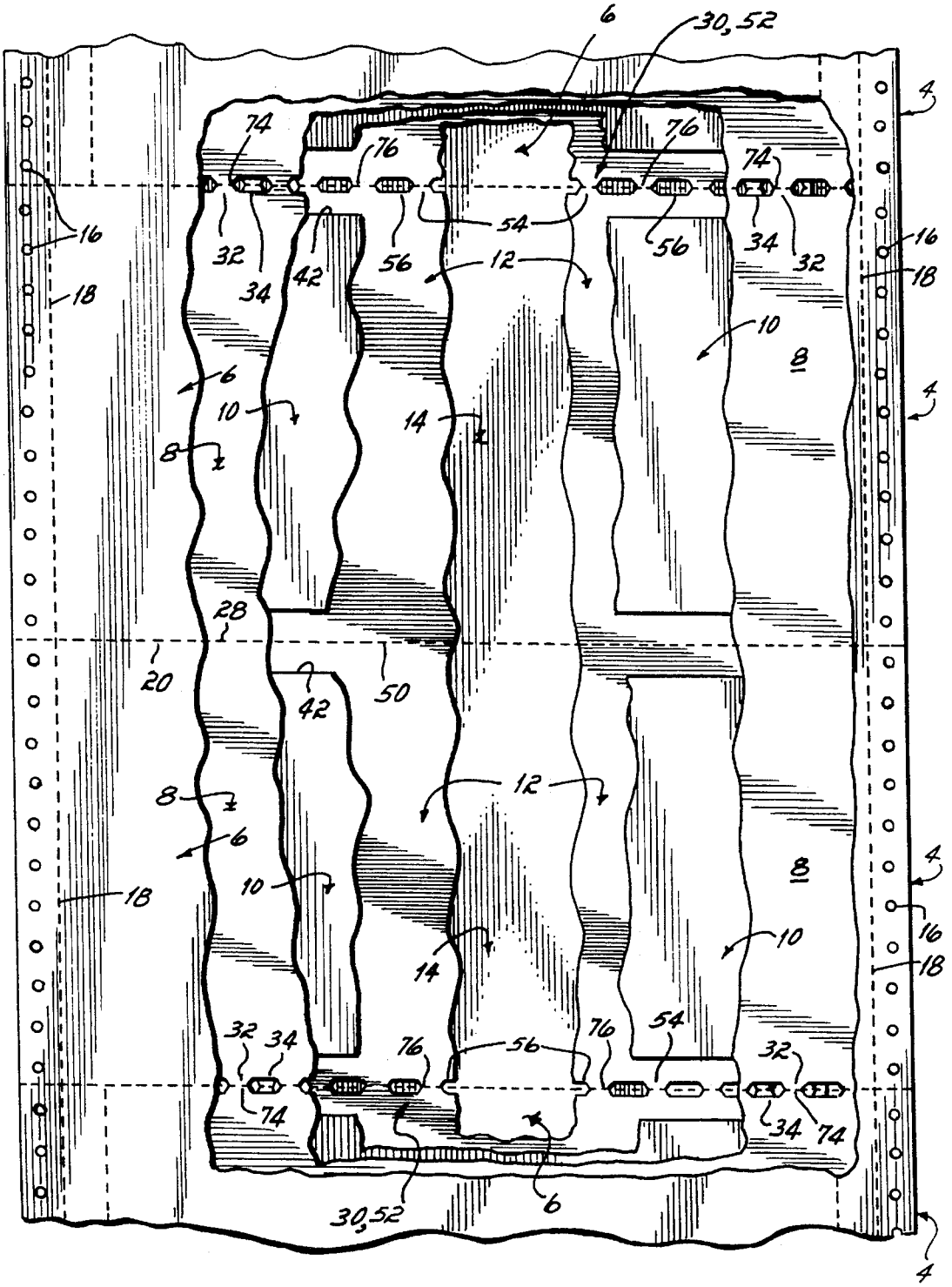
FIG. 3 is a top plane view, partially broken away, of two interconnected mailer units from the array of FIG. 1.

Referring now to FIG. 3, the ties 32 and slots 34 in adjacent plies 8, as well as ties 54 and slots 56 in adjacent plies 12 are shown in more detail. More particularly, it will be seen that ties 32 in ply 8 are transversely offset with respect to ties 54 in ply 12. Similarly, slots 34 in ply 8 are transversely offset with respect to slots 56 in ply 12. Further, slots 34 are located such that the fold line 33 is intermediate the top and bottom edges of the slots 34. Similarly, slots 56 are located such that the fold line 52 is intermediate the top and bottom edges of the slots 56. Each of the slots 34 and 56 is preferably approximately ½ inch wide and preferably approximately ⅛ inch tall. The ties 32 and 54 are preferably approximately 3/16 inch wide. Ply 8 includes a line of perforations 74 along fold line 33 and, similarly, ply 12 includes a line of perforations 76 along fold line 52. Perforation lines 74 and 76 preferably comprise four cuts per linear inch, with each cut being preferably less than approximately ¼ inch long, and approximately 0.0048 inch preferably spacing apart each of the cuts. Thus ties 32 and 54 are partially, but not completely, severed across their respective widths. The transversely offset relationship of ties 32 and slots 34 in ply 8 with ties 54 and slots 56 in ply 12 results in only a single thickness of material being required to be folded at the fold line as between the plies 8 and 12. Thus, the bulk at the fold of the assembly 2 is reduced which aids in alleviating tenting, but the plies remain connected across their widths thus stabilizing the plies during collation.

Those skilled in the art will readily recognize numerous adaptations and modifications which can be made to the mailer assembly of the present invention, yet all of which will fall within the spirit and scope of the present invention as defined in the following claims. For example, mailer units other than the so-called two-way insert ply saver mailer described herein can be fabricated incorporating to the principals of the present invention. Accordingly, the invention is to be limited only by the scope of the following claims and their equivalents.

What is claimed is:

1. A continuous mailer assembly comprising:

a plurality of interconnected units stackable into an array, each said unit including a first fly sheet ply, a second outgoing envelope face ply, a third insert ply, a fourth return envelope face ply and a fifth outgoing and return envelope back ply, said second and fifth plies cooperating to define an outgoing envelope, said fourth and fifth plies cooperating to define a return envelope, said third ply disposed between said second and fourth plies;

said second ply of one of said units being connected to said second ply of an adjacent unit with a series of transversely spaced ties;

said fourth ply of said one unit being connected to said fourth ply of said adjacent unit with a series of transversely spaced ties;

said second ply ties being transversely offset with respect to said fourth ply ties;

said second plies of said one and adjacent units and said fourth plies of said one and adjacent units including a series of transversely spaced slots which are separated by said ties;

said ties being partially cut transversely;

said mailer assembly thereby being foldable at the interconnection of said one and adjacent units with said second and fourth plies combining to form only a single ply thickness required to be folded.

* * * * *